US008907854B2

(12) United States Patent
Tsai et al.

(10) Patent No.: US 8,907,854 B2
(45) Date of Patent: Dec. 9, 2014

(54) ANTENNA STRUCTURE AND WIRELESS COMMUNICATION DEVICE EMPLOYING SAME

(71) Applicant: FIH (Hong Kong) Limited, Kowloon (HK)

(72) Inventors: Chih-Yang Tsai, New Taipei (TW); Chuan-Chou Chi, New Taipei (TW); Chi-Sheng Liu, New Taipei (TW); Hao-Ying Chang, New Taipei (TW)

(73) Assignee: FIH (Hong Kong) Limited, Kowloon (HK)

( * ) Notice: Subject to any disclaimer, the term of this patent is extended or adjusted under 35 U.S.C. 154(b) by 128 days.

(21) Appl. No.: 13/688,251

(22) Filed: Nov. 29, 2012

(65) Prior Publication Data

US 2013/0214978 A1 Aug. 22, 2013

(30) Foreign Application Priority Data

Feb. 16, 2012 (TW) ..... 101105095

(51) Int. Cl.

| | |
|---|---|
| ***H01Q 1/24*** | (2006.01) |
| ***H01Q 1/42*** | (2006.01) |
| ***H01Q 1/12*** | (2006.01) |
| ***H01Q 21/28*** | (2006.01) |

(52) U.S. Cl.

CPC ..... *H01Q 1/1264* (2013.01); *H01Q 1/243* (2013.01); *H01Q 21/28* (2013.01)

USPC ..... 343/702; 343/876; 343/872

(58) Field of Classification Search

None

See application file for complete search history.

(56) References Cited

U.S. PATENT DOCUMENTS

| | | | | |
|---|---|---|---|---|
| 8,330,658 | B2 * | 12/2012 | Ishii | 343/702 |
| 2006/0001581 | A1 * | 1/2006 | Lee et al. | 343/702 |
| 2008/0211721 | A1 * | 9/2008 | Ohba et al. | 343/702 |
| 2009/0066585 | A1 * | 3/2009 | Sato et al. | 343/702 |
| 2010/0245178 | A1 * | 9/2010 | Hsieh et al. | 343/702 |

* cited by examiner

*Primary Examiner* — Trinh Dinh

(74) *Attorney, Agent, or Firm* — Novak Druce Connolly Bove + Quigg LLP

(57) ABSTRACT

An antenna structure includes a first circuit board having a first antenna unit and a second antenna unit, a second circuit board having a first radio member and a second radio member, and a sliding mechanism. The first antenna unit and the second antenna unit are configured for receiving and transmitting different wireless signals. The sliding mechanism slides the second circuit board relative to the first circuit board, to separate or connect the first antenna unit with the first radio member and the second antenna unit with the second radio member, thus enabling the first antenna unit or a combination of the second antenna unit and the second radio member to receive and transmit a first wireless signal; the second antenna unit or a combination of the first antenna unit and the first radio member receive to transmit a second wireless signal.

10 Claims, 5 Drawing Sheets

ANTENNA STRUCTURE AND WIRELESS COMMUNICATION DEVICE EMPLOYING SAME

BACKGROUND

1. Technical Field

The present disclosure relates to antenna structures and wireless communication devices employing the antenna structures.

2. Description of Related Art

Many wireless communication devices (such as mobile phones) have multiple working frequency bands. Thus, multiple antennas corresponding to the working frequency bands are secured inside the devices, such as a GSM/CDMA wireless communication antenna, a WIFI antenna, and a GPS antenna. These antennas are usually located at different positions inside the devices to prevent mutual interference. However, when users are holding the devices to use, it is inevitable that one or more of the antennas are covered by hands of the users, which reduces a radiation efficiency of the antennas, thus degrading communication functions of the wireless communication devices.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawing like reference numerals designate corresponding parts throughout the views.

DETAILED DESCRIPTION

Figure 1:
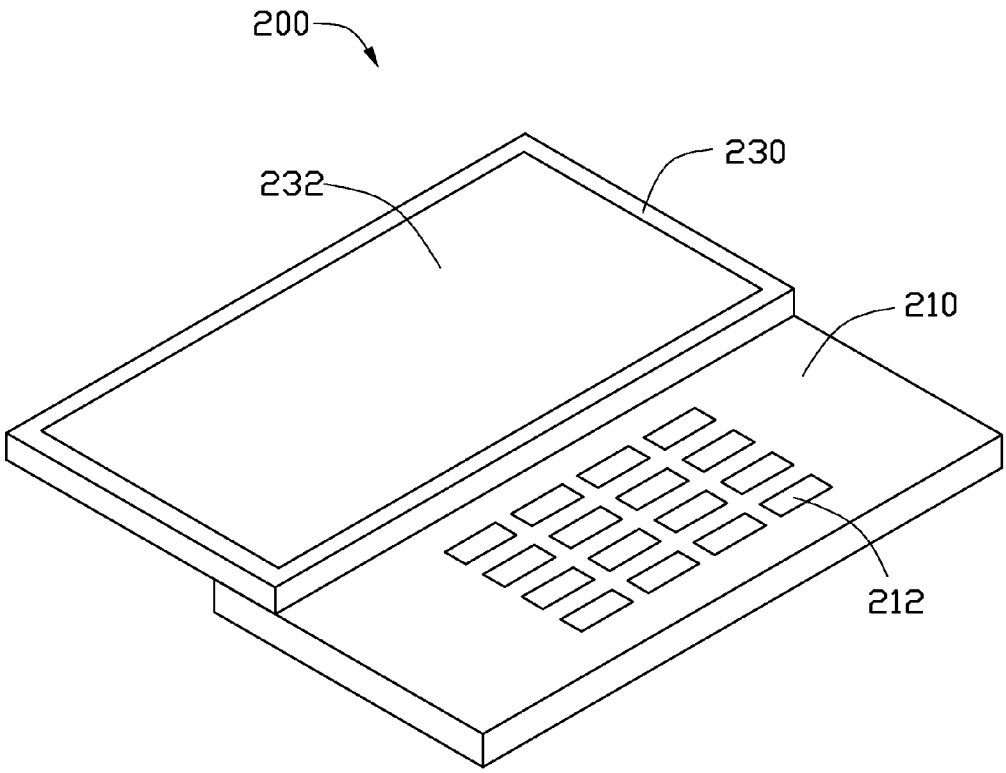
FIG. 1 is an isometric view of a wireless communication device in accordance with an exemplary embodiment.
Figure 2:
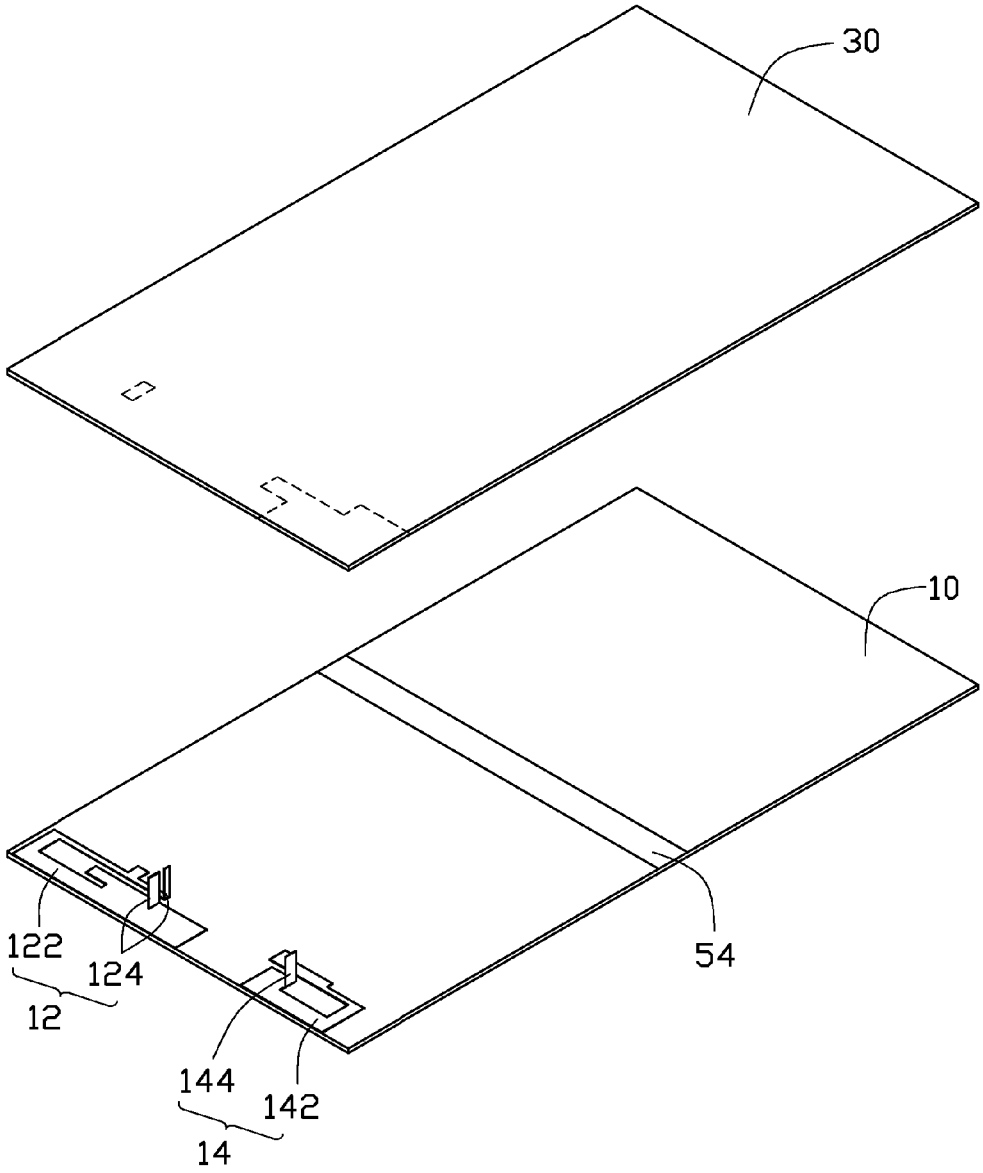
FIG. 2 is a partially disassembled, isometric view of an antenna structure in accordance with an exemplary embodiment.

FIG. 1 shows an exemplary embodiment of a wireless communication device 200 incorporating an antenna structure 100 (shown in FIG. 2). The wireless communication device 200 may be a mobile phone or a personal digital assistant, for example. In the exemplary embodiment, the wireless communication device 200 is a slidable mobile phone which comprises a main body 210 and a cover 230. The main body 210 may have a keyboard 212. The cover 230 may have a display 232. The cover 230 is slidably assembled to the main body 210. The cover 230 slides relative to the main body 210, to enable the wireless communication device 200 to be in an open or a closed state.

Figure 3:
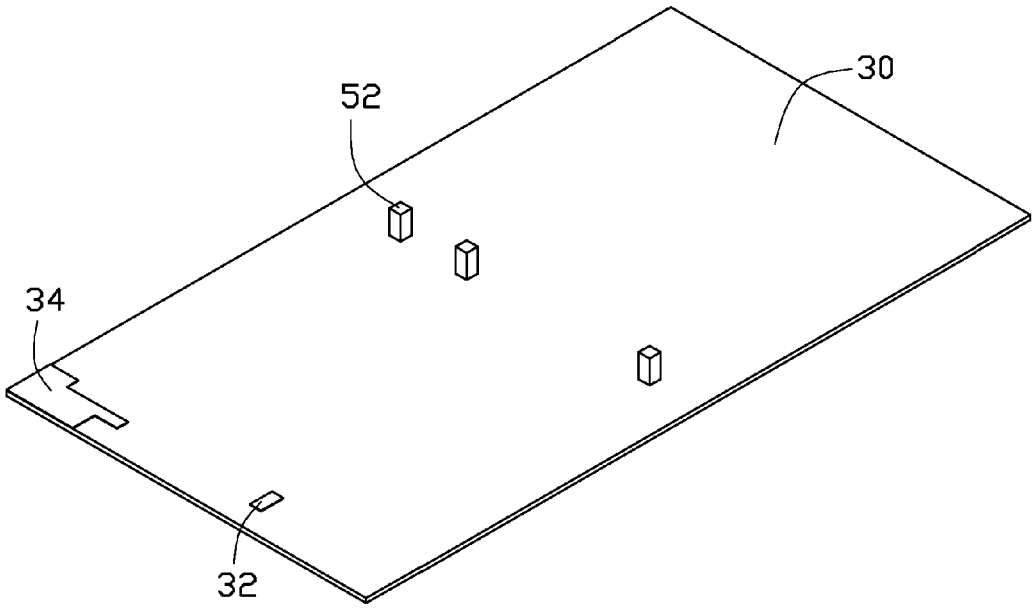
FIG. 3 is an isometric view of a second circuit board of FIG. 2 viewed from another angle.
Figure 4:
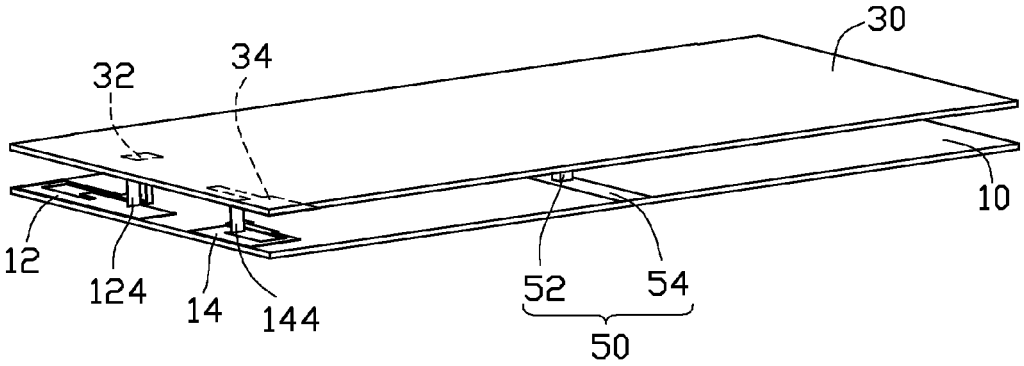
FIG. 4 is an assembled, isometric view of the antenna structure of FIG. 2 in an operating state.

Referring to FIG. 2 through FIG. 4, the antenna structure 100 has a first circuit board 10, a second circuit board 30, and a sliding mechanism 50. The first circuit board 10 is located inside the main body 210. The second circuit board 30 is located inside the cover 230. The sliding mechanism 50 is located between the first and second circuit boards 10, 30, functioning to slide the second circuit board 30 relative to the first circuit board 10.

The first circuit board 10 comprises a first antenna unit 12 and a second antenna unit 14 separately formed on a surface. The first antenna unit 12 and the second antenna unit 14 are used to receive and transmit wireless signals having different working frequencies.

In the exemplary embodiment, the first antenna unit 12 is a GPS antenna which comprises a first main radio member 122 and two first flexible sheets 124. The first main radio member 122 and the two first flexible sheets 124 are made of conductive materials, such as metal. The first main radio member 122 is attached to the first circuit board 10. The first main radio member 122 may be formed by plating a copper foil on the first circuit board 10 or by attaching an iron sheet to the first circuit board 10. The first main radio member 122 can also be formed by adhering a flexible circuit board on the first circuit board 10. The two first flexible sheets 124 both perpendicularly protrude from the first main radio member 122. Length of each first flexible sheet 124 is substantially equal to the distance between the first and second circuit boards 10, 30. The first main radio member 122 and the two first flexible sheets 124 are properly structured to enable the first antenna unit 12 to resonate a frequency band of about 10 MHz which covers the GPS frequency range 1.57-1.58 GHz, thus enabling the first antenna unit 12 to receive and transmit GPS signals.

In the exemplary embodiment, the second antenna unit 14 is a WIFI antenna which comprises a second main radio member 142 and a second flexible sheet 144. The second main radio member 142 and the second flexible sheet 144 are made of conductive materials, such as metal. The second main radio member 142 is attached to the first circuit board 10. The second main radio member 142 may be formed by plating copper foil on the first circuit board 10, or by attaching a iron sheet to the first circuit board 10. The second main radio member 142 can also be formed by adhering a flexible circuit board on the first circuit board 10. The second flexible sheet 144 perpendicularly protrudes from the second main radio member 142. Length of the second flexible sheet 144 is substantially equal to the distance between the first and second circuit boards 10, 30. The second main radio member 142 and the second flexible sheet 144 are properly structured to enable the second antenna unit 14 to resonate a frequency band of about 50 MHz which covers the WIFI frequency range 2.40-2.45 GHz, thus enabling the second antenna unit 14 to receive and transmit WIFI signals.

The second circuit board 30 has a first radio member 32 and a second radio member 34 separately formed on a surface facing the first circuit board 10. Each of the first radio member 32 and the second radio member 34 is a planar sheet. In the exemplary embodiment, size of the first radio member 32 is smaller than size of the second radio member 34. When the cover 230 is covered to the main body 210, the first radio member 32 contacts the two first flexible sheets 124 of the first antenna unit 12. Thus, the first main radio member 122 and the first radio member 32 are electronically connected through the two first flexible sheets 124 to form a loop antenna. The length of the current path in the loop antenna is in a certain proportion to the wavelength of the WIFI signals. Thus, the first antenna unit 12 and the first radio member 32 can cooperatively receive and transmit the WIFI signals. At the same time, the second radio member 34 contacts the second flexible sheet 144 of the second antenna unit 14. Thus, the second main radio member 142 and the second radio member 34 are electronically connected through the second flexible sheet 144 to create a lengthened current path thereof. The length of the current path between the second antenna unit 14 and the second radio member 34 is in a certain proportion to the wavelength of GPS signal. Thus, the second antenna unit 14 and the second radio member 34 can cooperatively receive and transmit the GPS signals.

The sliding mechanism 50 comprises a sliding block 52 and a sliding rail 54. In the exemplary embodiment, the sliding rail 54 is a recess defined in the first circuit board 10. The sliding block 52 is formed on the second circuit board 30. The sliding block 52 is slidably engaged with the sliding rail 54. Alternatively, the sliding block 52 can also be formed on the cover 230, and the sliding rail 54 is formed on the main body 210. As such, when the cover 230 slides relative to the main body 210, the second circuit board 30 slides relative to the first circuit board 10.

The operating principle of the antenna structure 100 is as follows.

Referring to FIG. 4, when the wireless communication device 200 is in a closed state (that is the cover 230 is covered on the main body 210), the second circuit board 30 is located above the first circuit board 10. At this time, the first antenna unit 12 and the first radio member 32 cooperatively receive and transmit WIFI signal, and the second antenna unit 14 and the second radio member 34 cooperatively receive and transmit GPS signal. When the first antenna unit 12 and the first radio member 32 are covered by a user's hand, the receiving and transmitting of WIFI signal can be interrupt. To normally receive and transmit WIFI signal at this time, the cover 230 is pushed to enable the second circuit board 30 to slide relative to the first circuit board 10. In this case, the two first flexible sheets 124 separate from the first radio member 32, and the second flexible sheet 144 separates from the second radio member 34. As such, the first antenna unit 12 turns to receive and transmit GPS signal, and the second antenna unit 14 turns to receive and transmit WIFI signal. Therefore, the wireless communication device 200 can continue to receive and transmit the WIFI signal by the second antenna unit 14.

Figure 5:
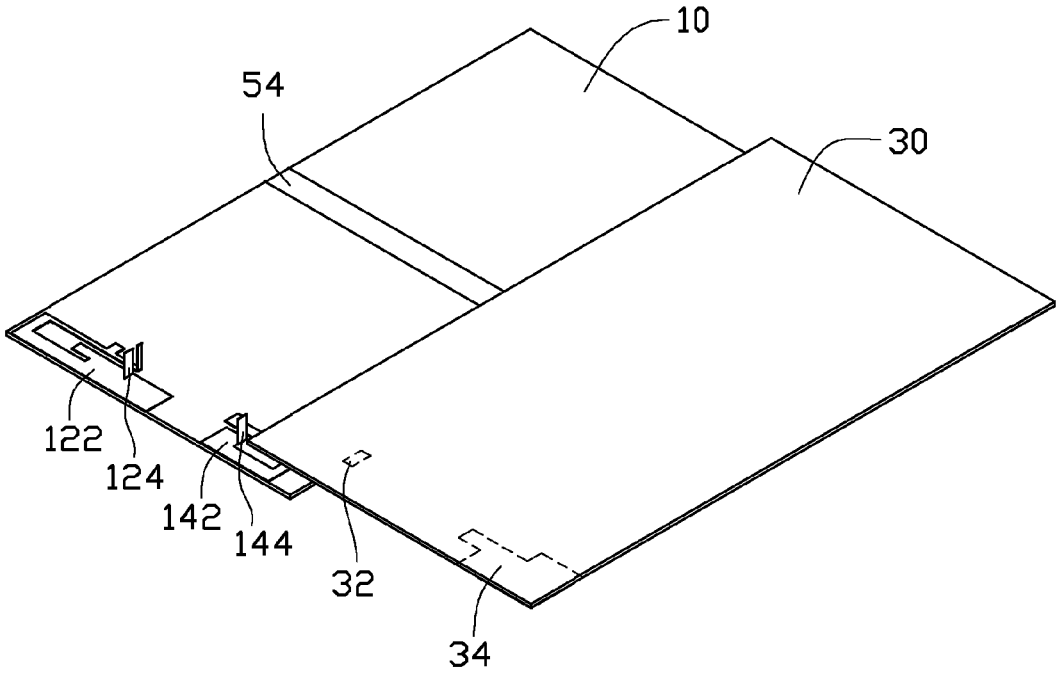
FIG. 5 is an isometric view of the antenna structure of FIG. 2 in another operating state.

Referring to FIG. 5, similarly, when the wireless communication device 200 is in an open state (that is the cover 230 is in an open position relative to the main body 210), if the first antenna unit 12 is covered by a user's hand, the receiving and transmitting of GPS signal can be interrupted. To normally receive and transmit the PGS signal at this time, the cover 230 is reversely pushed, enabling the second circuit board 30 to slide relative to the first circuit board 10 until the first radio member 32 contacts the two first flexible sheets 124 and the second radio member 34 contacts the second flexible sheet 144. Therefore, the wireless communication device 200 can continue to receive and transmit the GPS signal by a combination of second antenna unit 14 and the second radio member 34.

It should be understood, that the antenna structure 100 is not limited to receive and transmit WIFI signal and GPS signal. The antenna structure 100 can also be used to receive and transmit other signals, such as Bluetooth signal. In addition, the antenna structure 100 is not limited to receive and transmit two different kinds of signals. The antenna structure 100 can also be used to receive and transmit more than two different kinds of signals by increasing main radio members and flexible sheets to the first circuit board 10 and increasing radio members to the second circuit board 30 to engage with the increased main radio members on the first circuit board 10.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. An antenna structure, comprising:

a first circuit board comprising a first antenna unit and a second antenna unit, the first antenna unit and the second antenna unit configured for receiving and transmitting wireless signals;

a second circuit board comprising a first radio member and a second radio member; and a sliding mechanism positioned between the first and second circuit boards and configured to slide the second circuit board relative to the first circuit board, to enable the first antenna unit to separate from or contact the first radio member and enable the second antenna unit to separate from or contact the second radio member;

wherein when the first antenna unit separates from the first radio member and the second antenna unit separates from the second radio member, the first and second antenna units receive and transmit the wireless signals; when the first antenna unit contacts the first radio member and the second antenna unit contacts the second radio member, the first antenna unit and the first radio member corporately receive and transmit a first wireless signal, the second antenna unit and the second radio member corporately receive and transmit a second wireless signal.

2. The antenna structure as claimed in claim 1, wherein the first antenna unit comprises a first main radio member attached to the first circuit board and two first flexible sheets both perpendicularly protruding from the first radio member; wherein, when the second circuit board slides relative to the first circuit board, the two first flexible sheets separate from or contact the first radio member.

3. The antenna structure as claimed in claim 1, wherein the second antenna unit comprises a second main radio member attached to the second circuit board and a second flexible sheet perpendicularly protruding from the second radio member; wherein, when the second circuit board slides relative to the first circuit board, the second flexible sheet separates from or contacts the second radio member.

4. The antenna structure as claimed in claim 1, wherein the sliding mechanism comprises a sliding block formed on the second circuit board and a sliding rail formed on the first circuit board; the sliding block is slidably engaged with the sliding rail.

5. A wireless communication device, comprising:

an antenna structure comprising:

a first circuit board comprising a first antenna unit and a second antenna unit, the first antenna unit and the second antenna unit configured for receiving and transmitting wireless signals;

a second circuit board comprising a first radio member and a second radio member; and a sliding mechanism configured to slide the second circuit board relative to the first circuit board, to enable the first antenna unit to separate from or contact the first radio member and enable the second antenna unit to separate from or contact the second radio member;

wherein when the first antenna unit separates from the first radio member and the second antenna unit separates from the second radio member, the first and second antenna units receive and transmit the wireless signals; when the first antenna unit contacts the first radio member and the second antenna unit contacts the second radio member, the first antenna unit and the first radio member corporately receive and transmit a first wireless signal, the second antenna unit and the second radio member corporately receive and transmit a second wireless signal.

6. The wireless communication device as claimed in claim 5, further comprising a main body and a cover, the cover configured to slide relative to the main body; wherein, the first circuit board is located inside the main body, the second circuit board is located inside the cover.

7. The wireless communication device as claimed in claim 6, wherein when the first antenna unit separates from the first radio member and the second antenna unit separates from the second radio member, the cover is closed relative to the main body; when the first antenna unit is in contact with the first radio member and the second antenna unit is in contact with the second radio member, the cover is in an open position relative to the main body.

8. The wireless communication device as claimed in claim 6, wherein the sliding mechanism comprises a sliding block formed on the cover and a sliding rail formed on the main body; the sliding block is slidably engaged with the sliding rail.

9. The wireless communication device as claimed in claim 5, the first antenna unit comprises a first main radio member attached to the first circuit board and two first flexible sheets both perpendicularly protruding from the first radio member; wherein, when the second circuit board slides relative to the first circuit board, the two first flexible sheets separate from or contact the first radio member.

10. The wireless communication device as claimed in claim 5, wherein the second antenna unit comprises a second main radio member attached to the second circuit board and a second flexible sheet perpendicularly protruding from the second radio member;

wherein, when the second circuit board slides relative to the first circuit board, the second flexible sheet separates from or contacts the second radio member.

* * * * *